US007967479B2

(12) United States Patent
Dubuc

(10) Patent No.: US 7,967,479 B2
(45) Date of Patent: Jun. 28, 2011

(54) LED SIGNAL WITH LENS FOR SUN PHANTOM EFFECT REDUCTION

(75) Inventor: Eden Dubuc, Saint-Michel (CA)

(73) Assignee: GE Lighting Solutions, LLC, Cleveland, OH (US)

( * ) Notice: Subject to any disclaimer, the term of this patent is extended or adjusted under 35 U.S.C. 154(b) by 178 days.

(21) Appl. No.: 12/053,338

(22) Filed: Mar. 21, 2008

(65) Prior Publication Data

US 2009/0237928 A1 Sep. 24, 2009

(51) Int. Cl.
*F21V 5/02* (2006.01)
*F21S 4/00* (2006.01)

(52) U.S. Cl. ..... 362/339; 362/224; 362/249.02; 362/291; 362/311.02; 362/311.06

(58) Field of Classification Search ..... 362/545, 362/236, 240, 244, 249.02, 291, 311.01, 362/311.02, 311.06, 326, 339
See application file for complete search history.

(56) References Cited

U.S. PATENT DOCUMENTS

| | | | | |
|---|---|---|---|---|
| 4,733,335 | A * | 3/1988 | Serizawa et al. | 362/503 |
| 4,935,665 | A * | 6/1990 | Murata | 313/500 |
| 5,241,457 | A * | 8/1993 | Sasajima et al. | 362/503 |
| 6,509,840 | B2 | 1/2003 | Martineau | |
| 6,547,423 | B2 * | 4/2003 | Marshall et al. | 362/333 |
| 6,612,728 | B2 * | 9/2003 | Roller et al. | 362/521 |
| 6,961,190 | B1 * | 11/2005 | Tamaoki et al. | 359/726 |
| 7,175,305 | B2 | 2/2007 | Martineau | |
| 7,416,322 | B2 * | 8/2008 | Tanaka et al. | 362/514 |

* cited by examiner

*Primary Examiner* — Ismael Negron
(74) *Attorney, Agent, or Firm* — Fay Sharpe LLP

(57) ABSTRACT

An LED signal that includes a lens having an optical segment configured to direct at least some of the incoming generally collimated light rays from the sun passing through the lens away from an LED found in the traffic signal.

21 Claims, 4 Drawing Sheets

LED SIGNAL WITH LENS FOR SUN PHANTOM EFFECT REDUCTION

This application relates to signals, in particular, light emitting diode (LED) signals. More particularly, this application relates to an LED traffic signal that is less susceptible to the "sun phantom" effect.

BACKGROUND

With reference to FIG. 1, a known LED traffic signal 10 includes a housing 12, a printed circuit board 14 disposed in the housing, a plurality of LEDs 16 mounted on the printed circuit board, a lens 18, and a light-transmissive cover 20 that also connects to the housing. A gasket 24 can be provided to press against the light transmissive cover 20 and the housing 12 to protect the internal electrical components. The printed circuit board 14 receives electrical power through wires 26 connected to a plug-in socket 28 at one end and connector pins 32 at the other end. An electrical component 36 is provided on the printed circuit board 14 to condition the power that is received from the electrical power source.

LED signals attempt to collimate light to direct the light generated by the LEDs 16 towards the viewer of the signal. A schematic depiction of a portion of the lens 18 interacting with a respective LED 16 is shown in FIG. 2. In FIG. 2, the LED 16 is shown as a point light source that interacts with a portion of the collimating lens 18. Light rays 40 emitted from the LED enter the lens 18 at an inner surface 42 and are directed towards an outer surface 44 where they refract to generate a collimated light beam pattern.

LED signal lamps that employ a collimating lens are especially susceptible to the "sun phantom" effect because the most surfaces the LED package are highly reflective. With reference to FIG. 2, parallel light from the sun that impinges upon the outer surface 44 of the lens 18 is directed back towards the LED 16 since the incoming light rays follow the same path as the light rays 40 emanating from the LED. The incoming sunlight reflects off of the internal reflector of the LED package 16 back towards the lens 18. Since the internal reflector is so highly reflective, the reflected light can make the signal appear "on" to one viewing the signal.

Previous attempts to control the "sun phantom" effect in LED signals have employed the use of a large radius spherical outer distribution cover which is angled to reflect stray light away from the viewer towards the ground.

SUMMARY

A light emitting diode (LED) traffic signal that mitigates a "sun phantom" effect is described. The signal employs a lens that is spaced in relation to at least one LED in the traffic signal. The lens includes an optical segment having a configuration to direct some of the incoming collimated light rays passing through the lens away from the at least one LED. This mitigates the reflection of incoming sunlight off of the internal reflector of the LED package, which houses the LED. The traffic signal can include a housing, a support in the housing, the at least one LED mounted on the support and the lens. The lens can be spaced in relation to the at least one LED and have a configuration to direct light rays emitted from the at least one LED passing through the lens and to direct the light rays to form a substantially collimated beam pattern.

Another example of an LED traffic signal that overcomes the "sun phantom" effect employs a lens having an optical segment that includes an outer surface including collimating zones interrupted by interconnecting sections. This LED traffic signal also includes an LED that cooperates with the optical segment. The interconnecting sections on the outer surface of the optical segment are configured to deflect parallel light rays entering the lens from outside the traffic signal, e.g. sunlight, toward a portion of the inner surface of the optical segment that is shaped to direct the light rays away from the LED. In this embodiment, the LED traffic signal can include a housing, a support in the housing, at least one LED mounted on the support and the lens connected to the housing. The lens can include an inner surface through which light rays from the LED enter the lens and the outer surface through which light rays from the LED leave the lens. The inner surface can be configured to deflect light rays entering the lens from the LED toward the collimating zones. By directing incoming light, typically from the sun, away from the at least one LED, the "sun phantom" effect can be mitigated.

A lens for an LED traffic signal is also disclosed. The lens includes a first surface and a second surface. The first surface has a plurality of collimating zones and interconnecting sections connecting adjacent collimating zones. The second surface is divided into second surface sections. The second surface sections are configured to refract light entering the second surface sections from an associated point light source toward the collimating zones. The second surface sections are also configured to refract collimated light entering the interconnecting sections that is refracted towards the second surface sections away from the associated point light source.

DETAILED DESCRIPTION

Figure 1:
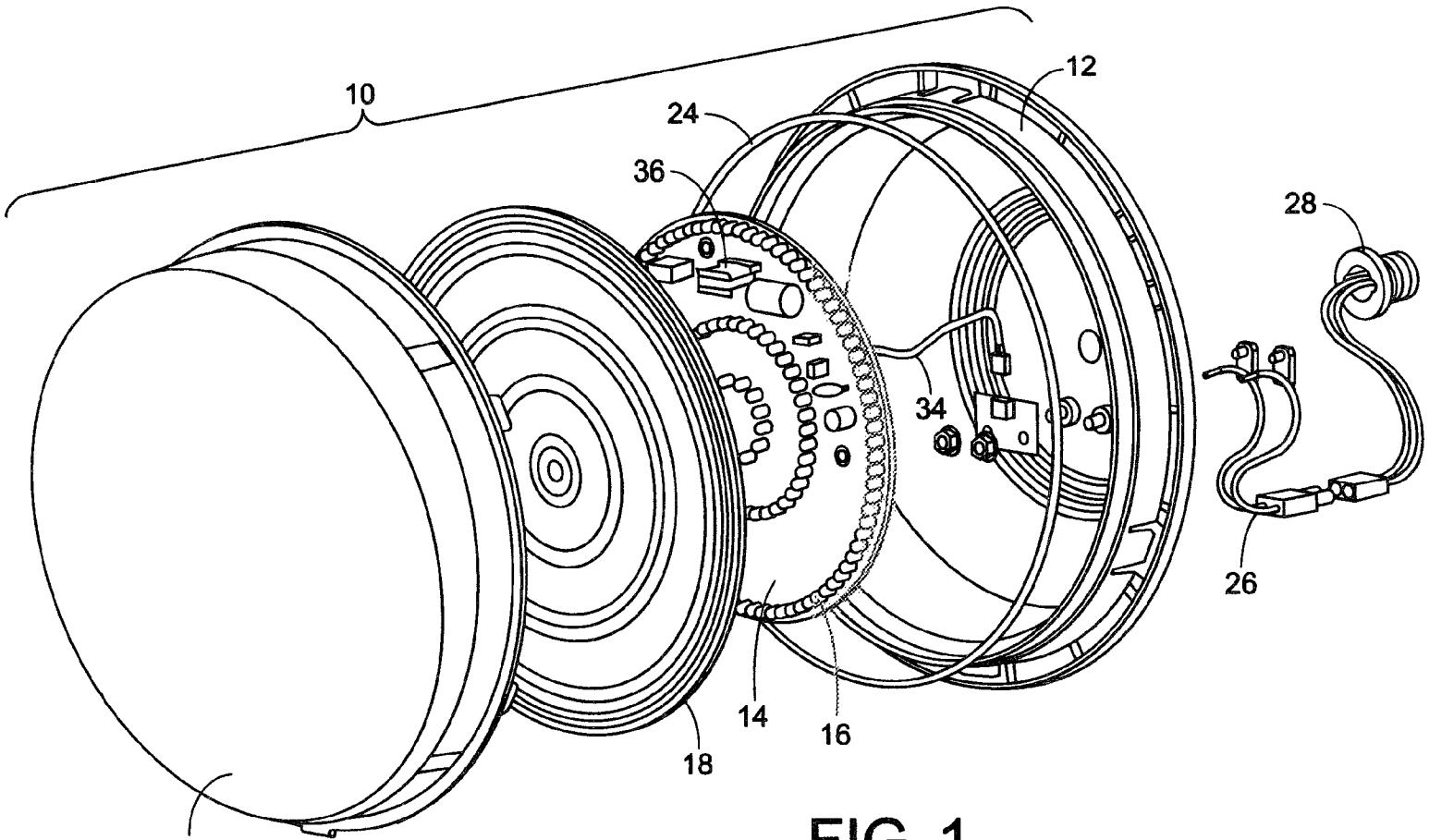
FIG. 1 (PRIOR ART)
FIG. 1 is an exploded view of a known LED traffic signal.
Figure 3:
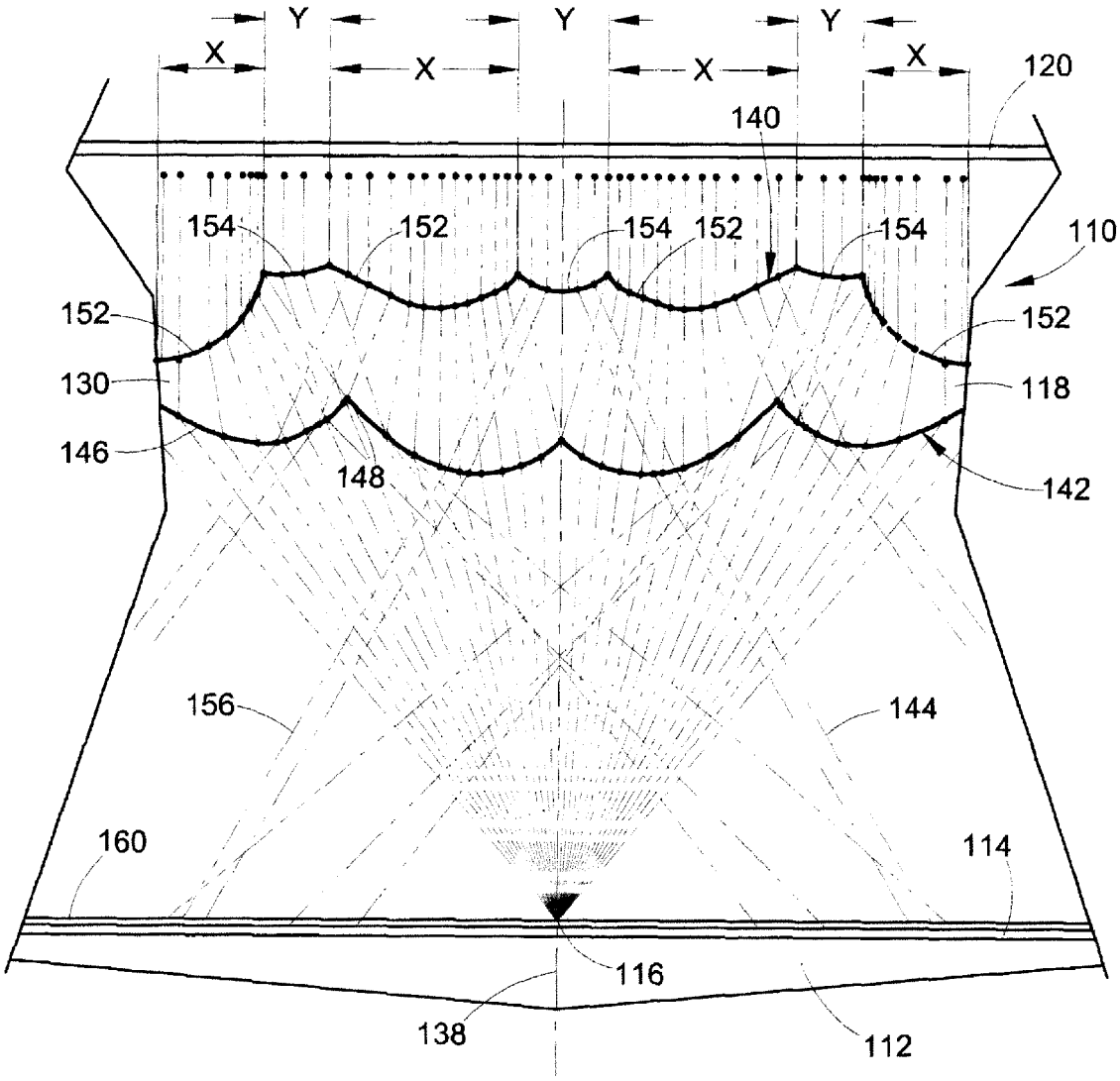
FIG. 3 is a schematic depiction an LED traffic signal that reduces the "sun phantom" effect.

With reference to FIG. 3, depicted schematically is a light emitting diode (LED) traffic signal 110 that is similar in its components and its configuration to the LED traffic signal shown in FIG. 1. FIG. 3 depicts a portion of the LED traffic signal in a schematic cross-sectional view. The light emitting diode traffic signal includes a housing 112, a support 114 in the housing, at least one LED 116 mounted on the support, and a lens 118 connected to the housing. The LED signal 110 can also include a light-transmissive cover 120 and other components similar to the signal in FIG. 1. The overall configuration of the assembled LED traffic signal 110 can be similar in configuration to the LED traffic signal more particularly described in U.S. Pat. No. 6,509,840. The housing 112 and the cover 120 can be the same as the housing 12 and the cover 120 shown in FIG. 1. The orientation of the LEDs 116 (only one is shown in FIG. 3) on the support 114, which in the depicted embodiment is a printed circuit board, will differ than the configurations disclosed in U.S. Pat. No. 6,509,840 due to the design of the lens 118.

The portion of the LED signal 110 shown in FIG. 3 schematically depicts a cross-section of the LED signal through a portion of the lens 118 that acts as an optical segment 130 that collimates the light from the LED 116 shown in FIG. 3. This cross section shown in FIG. 3 is taken with respect to the LED 116 and an axis 138 that provides an axis of revolution for the optical segment 130 of the lens 118 that cooperates with this LED. The lens 118 can be generally circular in configuration having a concentric axis that is radially offset from the axis of revolution 138. The lens 118 can include multiple optical segments 130 that each cooperate with a respective LED 116. Where the lens 118 is circular, the optical segments 130 and the LEDs 116 are each spaced a respective radius from the concentric axis of the lens.

Alternatively, the LED traffic signal can be similar to a directional signal such as the one more particularly described in U.S. Pat. No. 7,175,305. The lens 118 can act as a multiple collimated zone element that takes the form of a symbol such as an arrow, or other shape used for a traffic and/or rail signal. The optical segment 130 depicted in FIG. 3 can be an optical segment of a multiple collimated zone element, such as the one further described in U.S. Pat. No. 7,175,305. In this embodiment the optical segments 130 and the LEDs 116 would follow the pattern of the symbol to be illuminated.

Figure 2:
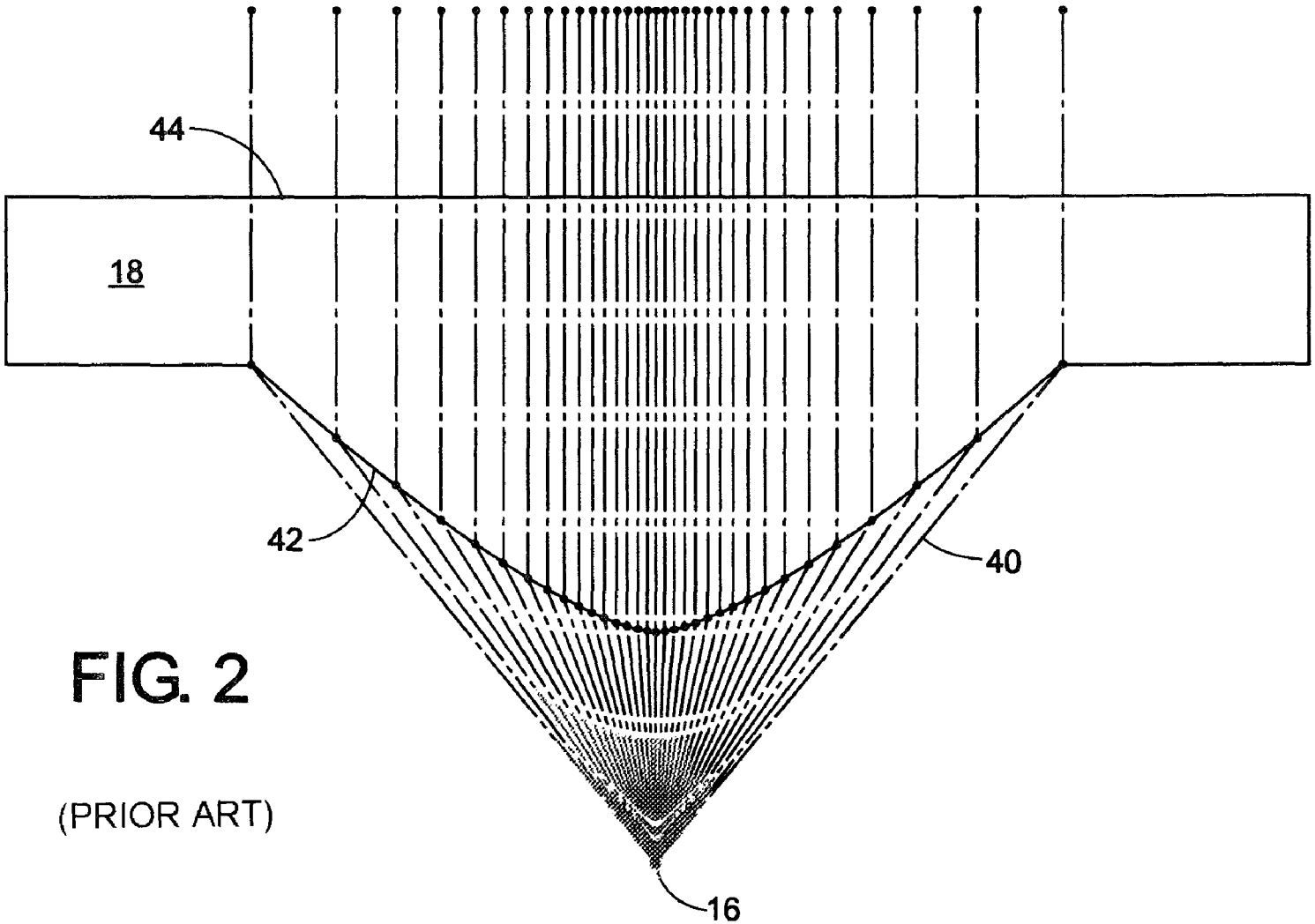
FIG. 2 (PRIOR ART)
FIG. 2 is a schematic depiction of one of the LEDs of the traffic signal shown in FIG. 1 interacting with a portion of the lens of the traffic signal that is shown in FIG. 1.

The lens 118, and more particularly the optical segment 130, is designed to concentrate the light rays emitted from the LED 116 to a smaller outer surface 140 as compared to known collimating lenses, e.g. the lens 18 depicted schematically in FIG. 2. This is because the "sun phantom" effect can be created from reflections from flat surfaces of a lens facing the sun directing incoming sunlight towards the LEDs and as a result of an internal reflector built into the LED package, this sunlight is reflected back and can appear to a viewer of the traffic signal that the traffic signal is "on." Providing a smaller outer collimating surface of the lens directs fewer light rays towards the LED packages, which reduces the reflection and thus the "sun phantom" effect.

The LEDs 116 mount on the support 114 in a conventional manner. The LEDs 116 can form a component of an LED package that emits light in a generally lambertian pattern. The lens 118 is spaced from the LED 116 and the support 114. The optical segment 130 of lens 118 includes an inner surface 142 through which light rays 144 from the LED 116 enter the lens and an outer surface 140 through which light rays from the LED leave the lens. The lower surface 142 is divided into lower surface sections 146 that interconnect at circular lines 148. The sections 146 direct at least substantially all incoming light rays from the LED 116 towards collimating zones 152 of the outer surface 140 of the lens. In this manner none, or nearly none, of the light that is generated by the LED is wasted by being directed in a non-collimated pattern. The beam that is generated is wider, however, than the beam generated by the optical segment depicted in FIG. 2.

Figure 4:
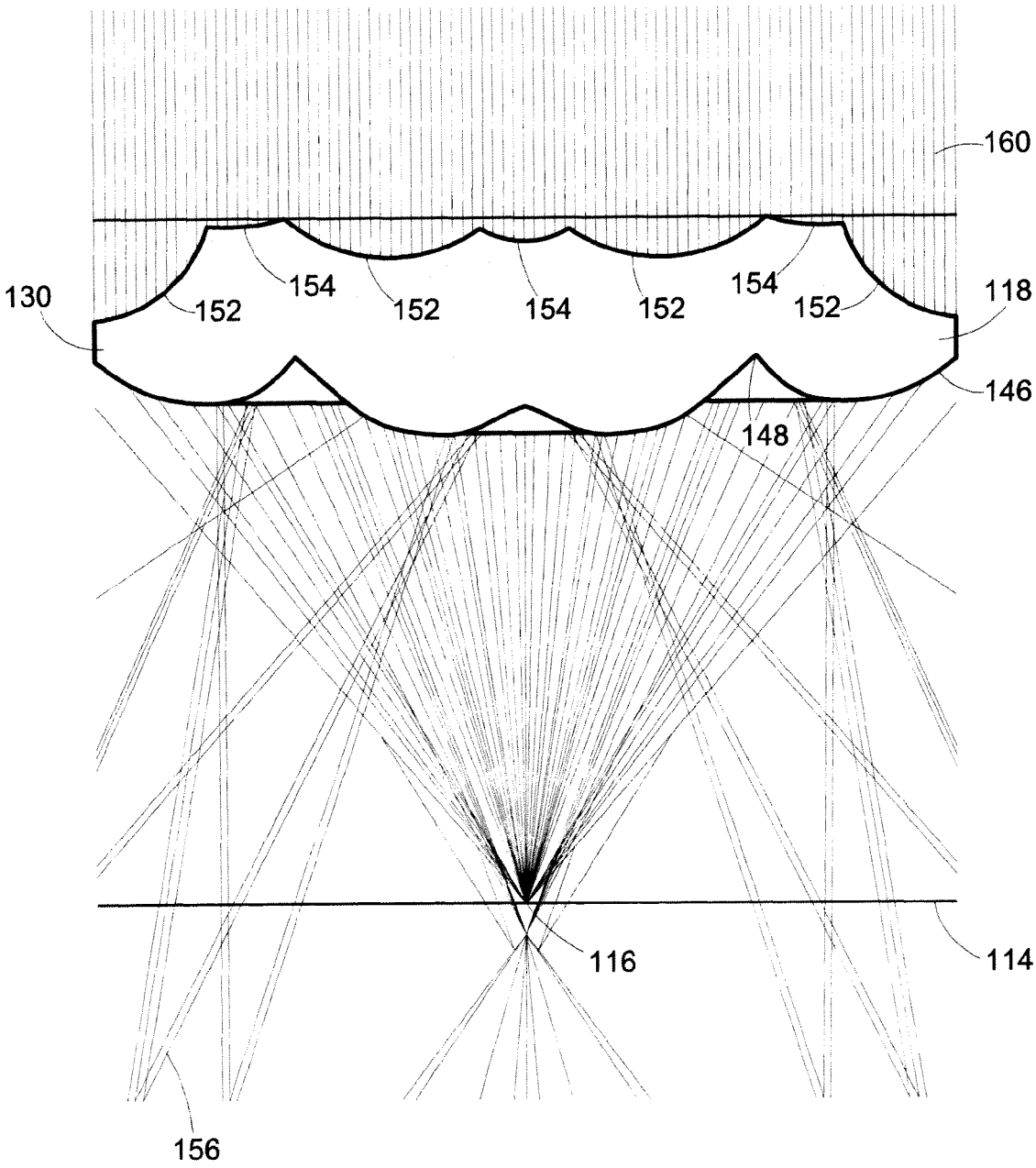
FIG. 4 is a schematic depiction of the lens shown in FIG. 3 where parallel light rays are shown entering the lens from outside of the signal and passing through the lens.

The collimating zones 152 direct light rays from the LED 116 to form a substantially collimated beam pattern. In FIG. 3, the light rays 144 that exit the lens 118 through the collimating zones 152 are shown as parallel to one another; however, light rays that pass through the collimating zones need not be exactly parallel with one another and the axis 138. For example, where most of the light rays are within about 20° beam angle is considered to be appropriate to form a substantially collimated beam pattern. The collimating zones are interrupted by interconnecting sections 154. The interconnecting sections 154 that connect the collimating zones 152 direct incoming generally collimated light rays (which typically will be coming from the sun) from outside the housing 112 and directs these refracted light rays 156 from the interconnecting sections toward the inner surface 142 of the lens 118 in a manner so that the inner surface 142 directs the incoming light rays away from the LED 116. Considering the area of the collimating zones 152 to be the sum of the cross-sectional dimensions x multiplied by a length, which can be approximated as a circumference about the axis of revolution 138, as compared to the area of the interconnecting sections 154, which is the sum the area corresponding to cross-sectional dimension y, it is desirable to increase the dimension y and lessen the dimension x. This is because sunlight in the form of parallel rays that impinge the collimating zones 152 is generally directed back towards the LED 116. With reference to FIG. 4, generally collimated incoming light rays 160 that strike the collimating zones 152 are directed generally towards the LED 116. On the other hand, incoming parallel rays that enter through the interconnecting sections 154 are directed towards the inner surface 142 of the lens 118 in a manner such that these light rays 156 are directed away from the LED 116. Accordingly, lessening the cross-sectional dimension x can result in less "sun phantom" effect.

As discussed above, the lens 118 connects to the housing 112. The lens 118 is spaced in relation to the LEDs 116 and has a configuration so that light emitted from the LED passes through the lens and is directed to form a substantially collimated beam pattern. The collimated beam pattern is the result of the lower sections 146 on the lower surface 142 directing all light rays, or substantially all light rays that enter the lens through these lower sections 146, towards the collimating zones 152 of the upper surface 140 of the lens 118. Incoming generally collimated light rays from the sun pass through the lens 118 and some of the rays are directed away from the LED 116.

The support 114 can be painted or coated with a material 160, e.g. solder mask, that is black or another color that absorbs light to further reduce the reflection of any incoming sunlight into the LED signal 110. The outer surface 140 of the lens 118 includes the interconnecting sections 154 that cooperate with the inner surface 142 to direct the incoming light away from the LED 116.

The lens 118, or at least the portion that cooperates with the LED 116, is designed assuming that light is being emitted from the LED 116 at about 40° measured from the axis of revolution 138. The axis 138 is perpendicular to the support 114.

The interconnecting sections 154 are generally perpendicular to the axis of revolution 138 for the optical segment 130 of the lens 118 that cooperates with one LED 116. This is in contrast to a Fresnel lens which would have interconnecting sections that are generally parallel to the axis of revolution between collimating zones. By making the interconnecting sections 154 generally perpendicular to the axis of revolution 138, the area of the interconnecting sections can be increased, which results in a reduction of the total are of the collimating zones 152. As discussed above, a reduction in the area of the collimating zones typically will result in a reduction of the "sun phantom" effect. Restated in another way in a cross section taken through the lens 118 and in which the axis 138 resides, the curve that the interconnecting zones 154 follows has a slope anywhere along the curve that will be typically greater than 45° measured from a line parallel to the axis of revolution, and more typically greater than about 60°.

The optical segment 130 of the lens 118 that cooperates with the LED 116 in the depicted embodiment has an equal number of lower divided sections 146 and collimating zones 152. Typically this is due to desiring each lower section 142 to direct light toward a corresponding collimating zone 152. Accordingly one less interconnecting section 154 is found on the outer surface 140 to interconnect the collimating zones 152.

Optical modeling comparing the lens and LED configuration shown in FIG. 2 as compared to the lens and LED configuration shown in FIG. 3 has shown a reduction in the luminous intensity as a result of reflections from the sunlight from the traffic signal. Moreover, the illuminance of the reflection from sunlight is spread over a larger area for the lens and LED configuration depicted in FIG. 3 as compared to the lens and LED configuration depicted in FIG. 2.

A light emitting diode (LED) traffic signal that provides a collimated output beam pattern while reducing the "sun phantom" effect has been described with reference to a particular embodiment. Modifications and alterations will occur to those upon reading and understanding the detailed description. The LED traffic signal can have a configuration with regard to the housing and other outer components of the signal that are similar to known LED traffic signals. An LED traffic signal that encompasses the invention described herein can result in a reduction in the "sun phantom" effect. The invention is not limited to only the embodiment disclosed. Instead, the invention is broadly defined by the appended claims and the equivalents thereof.

The invention claimed is:

1. A lens for an LED traffic signal comprising:

an outer surface having a plurality of concave collimating zones and interconnecting sections connecting adjacent collimating zones;

an inner surface divided into convex sections, the convex sections configured to refract light entering the convex sections from an LED toward the concave collimating zones and configured to refract collimated light entering the interconnecting sections that is refracted towards the inner-surface sections away from the LED, wherein each individual concave collimating zone of first surface has a surface area that is smaller than the surface area of each individual convex section of said inner surface, and wherein the interconnecting sections follow a curve in a cross section taken through the lens parallel to the collimated light rays entering the interconnecting section.

2. The lens of claim 1, wherein the convex sections are divided by lines formed in the lens.

3. The lens of claim 1, wherein the number of convex sections equals the number of collimating zones.

4. The lens of claim 1, wherein the interconnecting sections are generally perpendicular to the collimated lights entering the interconnecting sections.

5. A light emitting diode (LED) signal comprising:

a housing;

a support in the housing;

at least one LED mounted on the support; and a lens connected to the housing, the lens including an axis of revolution and an optical segment having an inner surface through which light rays emanating from the LED enter the lens and an outer surface through which light rays emanating from the LED exit the lens, said inner surface comprising a plurality of convex sections and said outer surface comprising a plurality of concave collimating zones interrupted by interconnecting sections, wherein the surface area of an individual collimating zone of said outer surface is smaller than the surface area of an individual lower surface section of said inner surface, the inner surface being configured to refract light rays entering the lens emanating from the LED toward the collimating zones, the interconnecting sections of the outer surface being configured to refract light rays parallel to said axis of revolution from outside the housing entering the lens through the interconnecting sections toward a portion of the inner surface that is shaped to direct the refracted light rays from the interconnecting sections away from the at least one LED.

6. The signal of claim 5, wherein the support is coated with a material that absorbs a majority of light that impinges upon the material.

7. The signal of claim 5, wherein the inner surface is shaped to refract substantially all light rays that enter the lens from the at least one LED at the inner surface toward the collimating zones.

8. The signal of claim 5, wherein the interconnecting sections are generally non-perpendicular to the light rays parallel to said axis of revolution entering the lens from outside the housing.

9. The signal of claim 8, wherein the interconnecting sections follow a curve in a cross section taken through the lens parallel to the parallel light rays entering the lens, a slope of the curve measured at least at a majority of points along the curve measures greater than about 45° from the parallel light rays entering the lens from outside the housing.

10. The signal of claim 5, wherein the inner surface is divided into x sections, each section configured to direct substantially all light entering the inner surface toward a respective collimating zone of the outer surface.

11. The signal of claim 10, wherein the outer surface includes y collimating zones, and x=y.

12. A light emitting diode (LED) signal comprising:

a housing;

a support in the housing;

at least one LED mounted on the support; and a lens connected to the housing and including an optical segment that cooperates with the at least one LED, the optical segment being spaced in relation to the at least one LED and having a configuration to direct light emitted from the at least one LED passing through an inner surface of the optical segment to an outer surface of the optical segment to form a substantially collimated beam pattern and to direct at least some incoming collimated light rays from outside the housing passing through the outer surface of the optical segment to the inner surface away from the at least one LED, wherein said inner surface comprises a plurality of convex sections and said outer surface comprises a plurality of adjacent concave collimating zones interrupted by interconnecting sections, wherein the convex sections of said inner surface are configured to converge light emitted from the at least one LED toward said concave collimating zones.

13. The signal of claim 12, wherein the interconnecting sections of the optical segment cooperate with the convex sections of the optical segment to direct collimated light rays entering the outer surface from outside the housing away from the at least one LED.

14. The signal of claim 12, wherein the optical segment defines an axis of revolution and the LED is centered along the axis of revolution.

15. The signal of claim 12, further comprising a plurality of LEDs and the lens includes a plurality of optical segments, each optical segment cooperating with a respective LED.

16. The signal of claim 12, wherein the inner surface is shaped to refract substantially all light rays that enter through the inner surface from the at least one LED toward said concave collimating zones of the outer surface that are shaped to direct the refracted light rays to form the substantially collimated beam pattern.

17. The signal of claim 16, wherein the interconnecting sections refract incoming collimated light rays that enter through the interconnecting sections from outside the housing toward the inner surface in a manner so that the inner surface directs the refracted light rays away from the at least one LED.

18. The signal of claim 17, wherein the number of inner surface sections equals the number of said concave collimating zones.

19. The signal of claim 18, wherein the lens is circular having an axis of rotational symmetry offset from the axis of revolution for each optical segment.

20. The signal of claim 18, wherein the lens is a multiple collimated zone element and the optical segments are positioned in the shape of a directional symbol.

21. A light emitting diode (LED) signal comprising:

a housing;

a support in the housing;

at least one LED mounted on the support; and a lens connected to the housing, the lens including an optical segment having an inner surface through which light rays emanating from the LED enter the lens and an outer surface through which light rays emanating from the LED exit the lens, the outer surface including concave collimating zones interrupted by interconnecting sections, the inner surface being configured to refract light rays entering the lens emanating from the LED toward the concave collimating zones, the interconnecting sections of the outer surface being configured to refract parallel light rays from outside the housing entering the lens through the interconnecting sections toward a portion of the inner surface that is shaped to direct the refracted light rays from the interconnecting sections away from the at least one LED, the interconnecting section being generally non-perpendicular to the parallel light rays entering the lens, and wherein the interconnecting sections follow a curve in a cross section taken through the lens parallel to the parallel light rays entering the lens.

* * * * *